US007743717B2

(12) United States Patent
Vera

(10) Patent No.: US 7,743,717 B2
(45) Date of Patent: Jun. 29, 2010

(54) APPARATUS FOR CONVEYING SOLID WASTE TO A FURNACE

(75) Inventor: Rodrigo B. Vera, Leeds, AL (US)

(73) Assignee: Plasma Waste Recycling, Inc., Huntsville, AL (US)

( * ) Notice: Subject to any disclaimer, the term of this patent is extended or adjusted under 35 U.S.C. 154(b) by 468 days.

(21) Appl. No.: 11/809,810

(22) Filed: Jun. 1, 2007

(65) Prior Publication Data

US 2008/0134948 A1 Jun. 12, 2008

Related U.S. Application Data

(60) Provisional application No. 60/873,748, filed on Dec. 8, 2006.

(51) Int. Cl.
*F23G 5/033* (2006.01)
*F23K 3/12* (2006.01)

(52) U.S. Cl. ..... 110/109; 110/223; 110/290; 100/41

(58) Field of Classification Search ..... 100/41, 100/92, 100, 188 R, 189; 414/198; 110/109, 110/223, 289, 290
See application file for complete search history.

(56) References Cited

U.S. PATENT DOCUMENTS 1,758,157 A * 5/1930 Edward ..... 110/169
3,580,166 A 5/1971 Longo
3,604,345 A * 9/1971 Boje ..... 100/100
3,756,143 A * 9/1973 Hennells ..... 100/100
3,828,663 A * 8/1974 Poplinski ..... 100/49
3,854,397 A * 12/1974 Dempster ..... 100/41
4,074,638 A 2/1978 Miller
4,100,849 A 7/1978 Pelton
4,121,515 A 10/1978 Tea
4,134,335 A * 1/1979 O'Rourke et al. ..... 100/179
4,217,175 A 8/1980 Reilly
4,438,705 A 3/1984 Basic, Sr.
4,471,704 A * 9/1984 John et al. ..... 110/281
4,650,546 A * 3/1987 Le Jeune ..... 110/223
4,732,092 A * 3/1988 Gould ..... 110/289
5,203,261 A * 4/1993 Davis ..... 100/42
5,280,757 A 1/1994 Carter et al.

(Continued)

FOREIGN PATENT DOCUMENTS

GB 425865 3/1935

(Continued)

*Primary Examiner*—Kenneth B Rinehart
*Assistant Examiner*—David J Laux
(74) *Attorney, Agent, or Firm*—George P. Kobler; Lanier Ford Shaver & Payne P.C.

(57) ABSTRACT

An apparatus for conveying solid waste to a furnace includes an opening to an elongated channel into which waste material is received and an outlet open to the furnace. A reciprocating ram with a head plate located in the channel opposite the outlet forces the waste toward the outlet. The ram also has an upper shield dimensioned to be slightly greater in area than the opening such that the opening is blocked when the ram is extended. The channel also includes an actuator-impelled restrictor plate for compressing waste as it is forced through said channel into a narrower portion, and a isolation door operable to close off the channel.

20 Claims, 13 Drawing Sheets

U.S. PATENT DOCUMENTS

| | | | | |
|---|---|---|---|---|
| 5,353,698 | A | 10/1994 | Robbins | |
| 5,461,975 | A * | 10/1995 | Driggs | 100/191 |
| 5,517,908 | A | 5/1996 | Stout | |
| 5,634,414 | A | 6/1997 | Camacho | |
| 5,664,491 | A * | 9/1997 | Maki et al. | 100/41 |
| 6,138,557 | A * | 10/2000 | Brown et al. | 100/41 |
| 6,178,882 | B1 * | 1/2001 | Wagner et al. | 100/98 R |
| 6,367,395 | B1 | 4/2002 | Masek | |
| 6,380,507 | B1 | 4/2002 | Childs | |
| 6,823,776 | B1 | 11/2004 | Olds | |
| 7,507,087 | B2 * | 3/2009 | Tenzek | 432/126 |

FOREIGN PATENT DOCUMENTS

| | | |
|---|---|---|
| GB | 1148624 | 4/1969 |

* cited by examiner

A-A

APPARATUS FOR CONVEYING SOLID WASTE TO A FURNACE

CROSS-REFERENCE TO RELATED APPLICATIONS

This application claims priority of U.S. Provisional Application Ser. No. 60/873,748 filed Dec. 8, 2006, and incorporated by reference herein.

FIELD OF THE INVENTION

This invention relates to furnaces, specifically to furnaces for the conversion of waste, and more specifically to high temperature furnaces, and even more particularly to apparatus for conveying such waste to such high temperature furnaces.

BACKGROUND

For centuries, solutions have been sought as to what to do with solid waste that communities and industries tend to generate. Waste has been buried, sunk, and where possible recycled, or converted to other uses, to remove such waste from human habitation. For decades, efforts have been made to convert waste to other useful materials by the application of a high-temperature plasma arc or torch, a.k.a. pyrolytic conversion. The resulting products of this conversion include metals, and product synthesis gas, or "syngas."

The products obtained from the plasma conversion process have many uses in other areas and so can be of value. However, the reaction should ideally be controlled in order to predict the resulting syngas composition. Variables that require the greatest control in the process include the amount and composition of solid waste, including municipal solid waste (MSW), the speed at which the waste material is fed into the furnace, the density of the material, and the amount of ambient air trapped within the material.

Most feed systems relate to waste compaction and baling systems. While these systems serve to reduce the size and increase the mass of the material that would be processed, they do not account for the air density within the material. Furthermore, they are not compatible for use with high-temperature furnaces. Feeders operating in such environments must not only include heat-tolerate components, but must include certain safety features that may prevent blow back of hot furnace gases into the feeder apparatus.

BRIEF DESCRIPTION OF THE DRAWINGS

The present invention is described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION

The various embodiments of the present invention and their advantages are best understood by referring to FIGS. 1 through 10 of the drawings. The elements of the drawings are not necessarily to scale, emphasis instead being placed upon clearly illustrating the principles of the invention. Throughout the drawings, like numerals are used for like and corresponding parts of the various drawings.

Furthermore, reference in the specification to "an embodiment," "one embodiment," "various embodiments," or any variant thereof means that a particular feature or aspect of the invention described in conjunction with the particular embodiment is included in at least one embodiment of the present invention. Thus, the appearance of the phrases "in one embodiment," "in another embodiment," or variations thereof in various places throughout the specification are not necessarily all referring to its respective embodiment. Moreover, features described with respect to a particular embodiment may also be employed in other disclosed embodiments as those skilled in the relevant arts will appreciate. This invention may be provided in other specific forms and embodiments without departing from the essential characteristics as described herein. The embodiments described below are to be considered in all aspects as illustrative only and not restrictive in any manner.

Figure 1A:
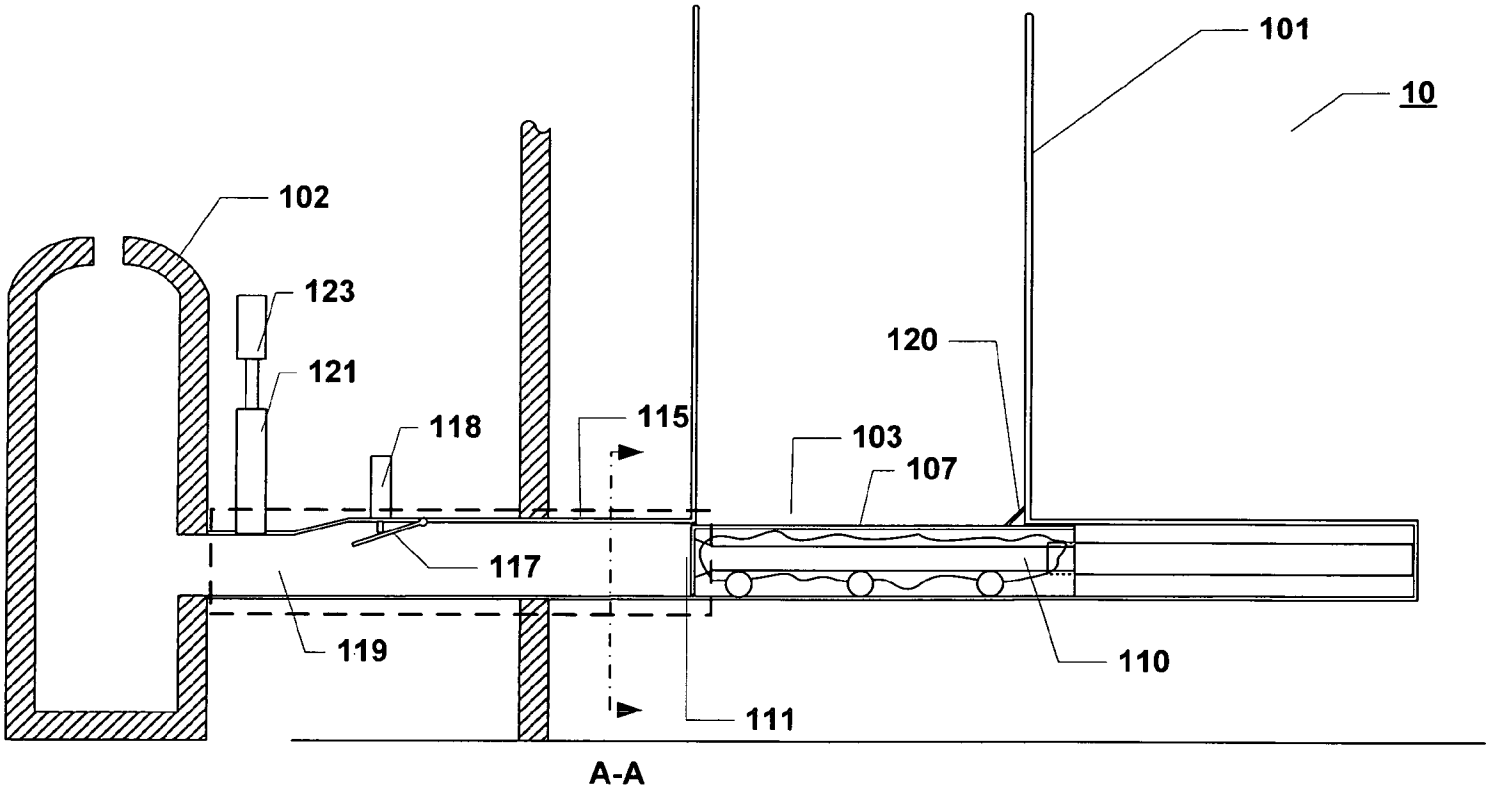
FIG. 1A depicts one exemplary embodiment of an apparatus for conveying waste to a furnace.

FIG. 1A depicts an elevational view of an exemplary feeder system 10 for a furnace 102, preferably a pyrolitic furnace or reactor where air intrusion or density control is important. The feeder system consists of a hopper section 101 having an opening 103 in its bottom (more clearly perceived in FIG. 1B). The opening 103 communicates with a channel 105 within which is housed a hydraulic ram 110. The hydraulic ram 110 is covered with an upper shield 107 which is dimensioned to be slightly wider and slightly longer than the length and width of the opening 103. Attached to the head of the hydraulic ram 110 is ram head plate 111. The channel 105 extends into a compaction box 115 which is configured such that the ceiling thereof lowers going from the channel area 105 to the furnace 102. A restrictor plate 117 is pivotally attached by its upstream side to the ceiling of the compaction box 115. Restrictor plate 117 is driven by a hydraulic actuator 118 which imparts downward force on the restrictor plate 117 according to a set of prescribed conditions which will be discussed in greater detail below. The compaction box 115 then extends into throat area 119 with a reduced cross-sectional area compared to the compaction box 115 by virtue of the lowered ceiling. The restrictor plate 117 is preferably long in order to provide an obtuse angle between the plate and the ceiling of the compaction box 115, and thus a longer transition to the reduced cross-section. At the end of the throat area there is, preferably, a water-cooled isolation door 121, which is kept open, and operated by a second hydraulic actuator 123.

Figure 2:
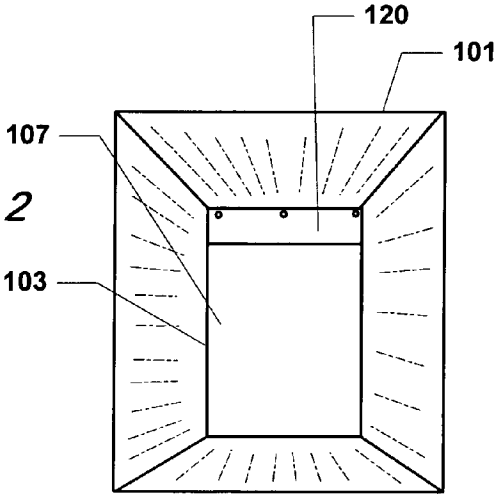
FIG. 2 is a top plan view of one embodiment of the hopper.

In operation, solid waste materials are dumped into the hopper 101 and fall to the opening 103. When ram 110 is extended, as shown in FIG. 1A, upper shield 107 provides closure for the opening 103 to prevent the waste from entering the channel 105 until previously-fed waste is out of the way. FIG. 2 is a top plan view of the inside of the hopper 101 with shield 107 shown closing off the opening 103. An optional scrape plate 120 (also shown in FIG. 1) may be affixed to the rear bottom side of the hopper 101, preferably at an angle with respect to the shield 107, to prevent waste from being carried back into the ram section of the channel 105 when the ram retracts.

Figure 1B:
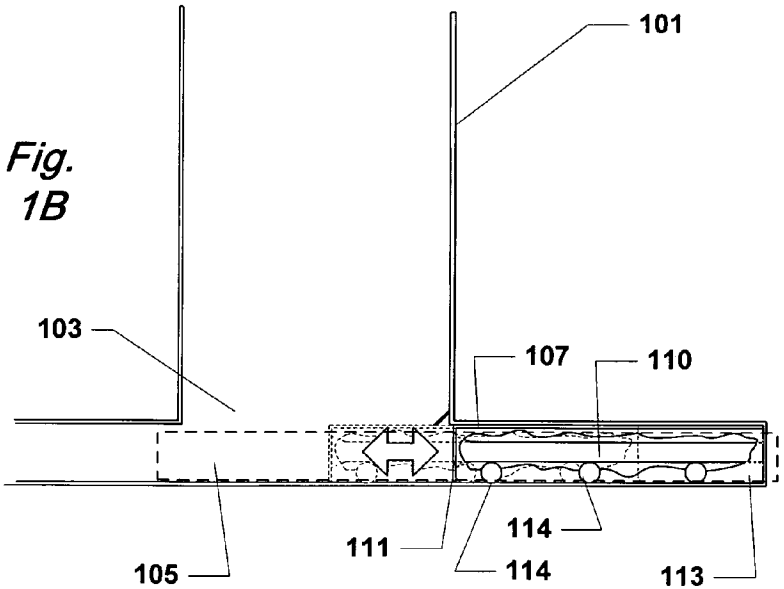
FIG. 1B depicts a portion of the apparatus of FIG. 1A with the hydraulic ram retracted.

At a prescribed cycle time, the ram 110 is retracted, as shown more clearly in FIG. 1B, thereby withdrawing the upper shield 107 from the opening 103 and allowing the solid waste to fall into the channel 105. At a second prescribed cycle time, ram 110 extends again to force the solid waste into the compaction box 115 and against the restrictor plate 117. The restrictor plate 117 applies downward force on the solid waste to reduce its volume so as to fit into the throat area 119 prior to entering the furnace 102. The force exerted by the restrictor plate 117 coupled with the force exerted by the ram 110 compacts the waste material and forces out trapped air prior to its entry into the furnace.

It should be noted that while the reduction in cross-sectional area is shown in the drawings to occur through lowering the ceiling of the throat area 119 compared to the channel 105, the same result may be obtained, as those skilled in the art will appreciate, by decreasing the side wall interior separation. For that matter, one or more restrictor plates, similar to the restrictor plate 117 may be installed on the side walls including actuators for providing lateral force to the side wall restrictor plates.

The operation of the hydraulic systems may be controlled by one or more computer systems configured with control logic to issue control commands to adjust the timing of ram 110 or actuator movement, and to adjust the force exerted (hereinafter, the "control system"). To insure a uniform, predictable density of the waste entering the furnace, the force imparted by actuator 118 is controlled such that it is inverse to the force imparted by ram 110. This may be accomplished through one or more sensors which detect the pressure exerted by the ram 110. Data from the one or more sensors is used as input to the control system which is configured with logic to evaluate the pressure data from the ram 110 and output a control signal to the actuator 118 to either increase or decrease force in order to remain inverse to the force exerted by the ram 110. For example, if the ram 110 must exert an increased amount of force to impel the waste through the channel 105, data from the one or more sensors indicates this condition, communicates it to the control system which then orders the actuator to apply decreased force to the restrictor plate 117. Conversely, if the ram exerts less force to move waste, the control system, upon receiving this data, issues a command to the actuator 118 to increase force applied to the restrictor plate 117. The result is a bolus of solid waste compacted to a density that is substantially uniform with respect other waste processed by the apparatus 10. Furthermore, air is forced from the waste and is expelled through the opening. In this way, the types and amounts of materials that result from the reaction in the plasma furnace are more predictable and controllable.

Referencing FIG. 1B, in one embodiment ram 110 includes a side panel 113 on either side to which are attached a plurality of guide wheels 114 which ease the travel of the ram by decreasing friction. The side panels 113 help to prevent debris from infiltrating the ram and its mechanical components, in addition to providing structure on which to mount and support the guide wheels 114. It will be appreciated in the art that any suitable structure can be used to mount and support the guide wheels, however.

Figure 3:
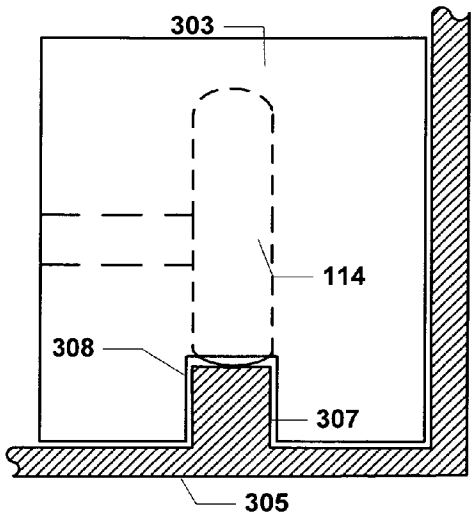
FIG. 3 depicts a wheel guard that may be used in an embodiment of the apparatus.

FIG. 3 illustrates an exemplary embodiment comprising features that may be used with guide wheels 114. Guide wheel 114 (shown in broken outline) is mounted to the covering or support structure of the ram 110 as described above. A wheel guard 303 is also mounted to the structure. The wheel guard 303 also helps to prevent debris from entering the wheel mechanism.

In another embodiment, the floor 305 of the channel 105 may comprise a ridge, rib, or wall structure, on which the wheel rides, an example of which is shown at 307. The wheel guard 303 in this instance is configured with a cut-out 308 to accommodate the wall structure 307.

Figure 4:
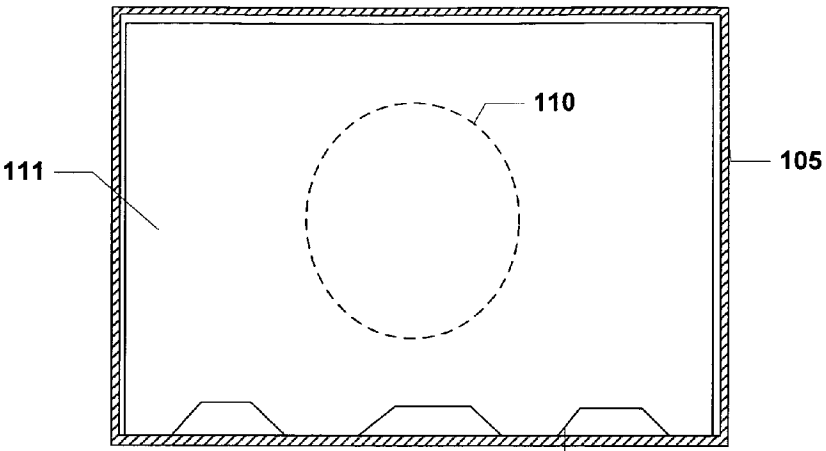
FIG. 4 is an elevational view of the ram head plate according to an embodiment of the apparatus.
Figure 14:
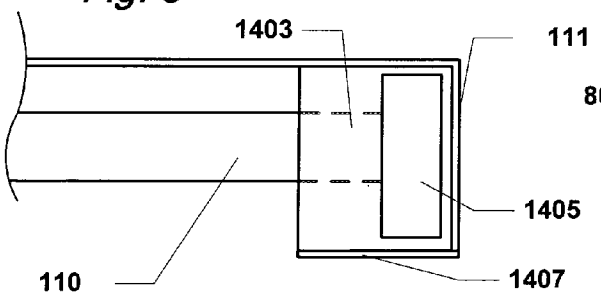
FIG. 14 is an elevational view of a ram with side and bottom skid plates.

A version of the ram head plate 111 is depicted in elevational view in FIG. 4. The ram head plate 111 is attached to ram 110 (shown in dashed outline) by any suitable methods now known in the art or hereafter developed, including without limitation, welding. The ram head plate 111 includes an irregular bottom edge 403 to aid in preventing thin material, such as paper, cardboard and the like from going under the ram head plate 111. Although trapezoidal cut-outs are shown, it will be appreciated that cutouts of other shapes may be used. The typical shape is rectangular as bars to the floor to accommodate, for example, rectangular ridge 307 welded to the floor of the channel 105. Another embodiment of the ram 110 shown in FIG. 14, includes a shroud 1403 that extends back from the head plate 111. Shroud 1403 in this embodiment may include a side skid plate 1405 affixed to the surface of the shroud 1403 that abuts the surface of the lateral wall of the channel 105. In the alternative, shroud may include a bottom skid plate 1407 which rests on the floor of the channel. Still further, the shroud 1403 may include both side and bottom skid plates 1405, 1407. The purpose of the skid plates is to reduce friction between the ram 110 and the channel walls and floor. To this end, skid plates are preferably formed of a substantially frictionless, durable substance, for example, UHMWPE, or the like.

Figure 8:
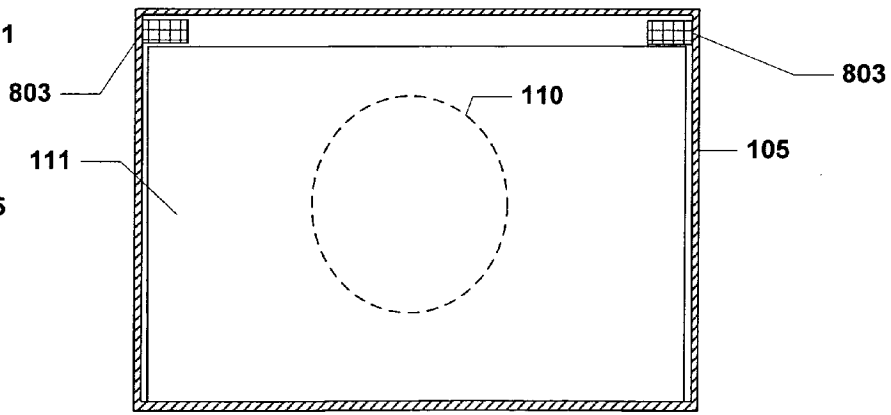
FIG. 8 is head-on elevational view of the channel and the ram head.

It should also be noted that in the embodiment depicted, the channel 105 cross-section is rectangular having a greater width than height. The size of the ram head plate is dimensioned to substantially fill the channel, but preferably dimensioned to provide a clearance of about one eighth to about one fourth inch. With reference to FIG. 8, another embodiment is shown wherein the channel 105 includes channel guide blocks 803 that may be attached to the top of the side walls of the channel in the area of the ram 110 to prevent upward movement of the ram 110 as it is extended. Also, as an alternative to guide blocks may be formed from any suitable material including steel, cast iron, ultra-high molecular weight polyethylene (UHMWPE), Teflon® or structures that combine these materials.

Figure 9:
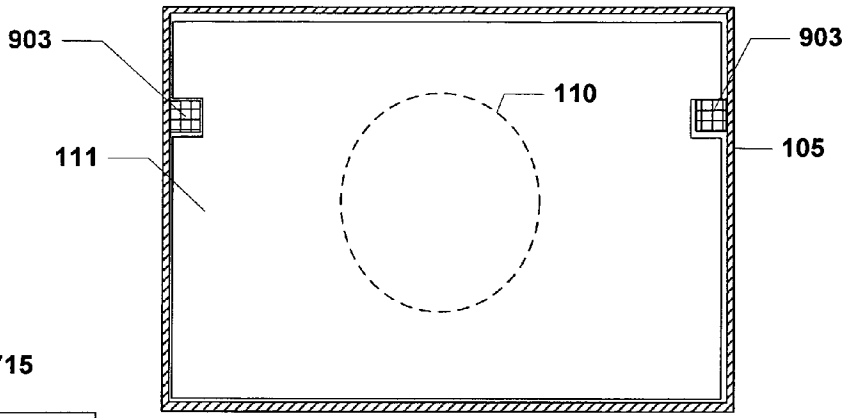
FIG. 9 is head-on elevational view of the channel and ram head according to another exemplary embodiment.

FIG. 9 provides an end-on view of another exemplary version of the ram head plate 111 with additional features in the channel 105. This embodiment may be used with or without guide wheels. Channel 105 includes guide rails 903 upon which the ram head 111 rests. Guide rails 903 are made of a low friction, highly durable substance such as UHMWPE, and serve to guide ram during this movement while easing the travel through preventing or reducing friction. It will be appreciated that although guide rails 903 are shown as rectangular, any shape may be used. Further, other materials may be used to form the guide rails provided that the goal of less friction is achieved. For example, guide rails could be formed from steel, or other metal or metal alloy, that is adequately lubricated. However, this implementation will require constant servicing, and therefore, increased downtime of the apparatus.

Figure 10:
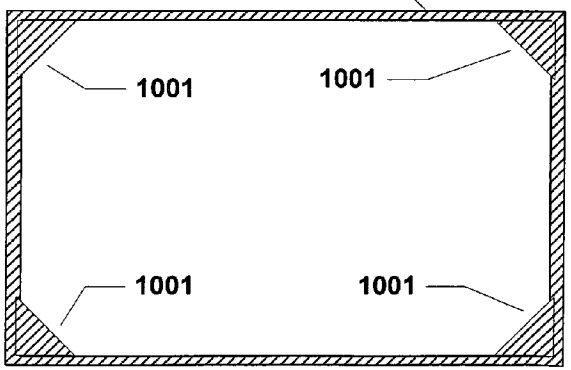
FIG. 10 is yet another head-on elevational view of the channel according to another exemplary embodiment.

FIG. 10 shows a further design of the inside of the channel 105 wherein generally chamfered corners 1001 are included to eliminate 90° corners in which fine waste material could accumulate. This design reduces the effect of such accumulation and increases the reliability of the apparatus.

Figure 5A:
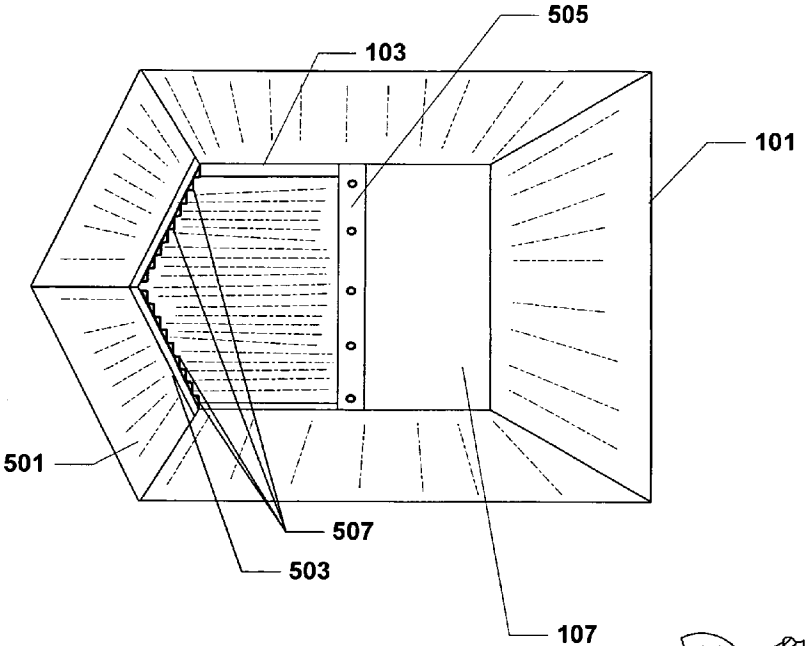
FIG. 5A is a top plan view of another embodiment of the hopper and ram.
Figure 5B:
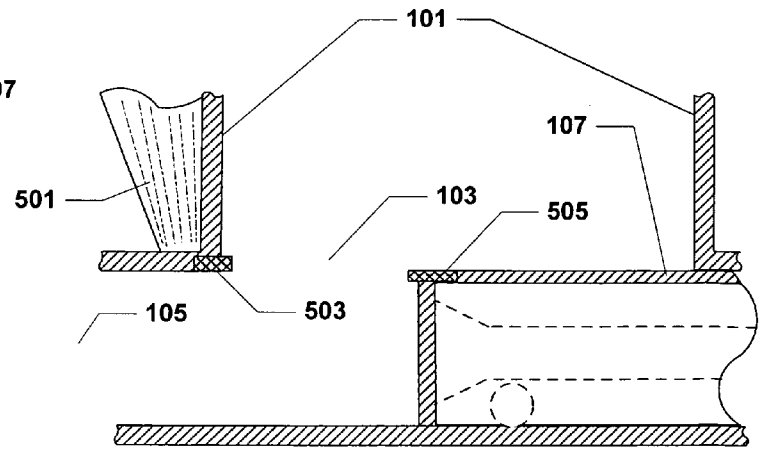
FIG. 5B is a side elevational view of the embodiment of FIG. 5A.

In another embodiment, the apparatus includes features which aid in clearing large pieces of debris from the hopper 101 and opening 103. In FIGS. 5A and B, the rear side wall 501 of the hopper 101, so designated with respect to the direction of debris movement, is generally angled having a vertex at roughly the midpoint of the wall. FIG. 5A is a top plan view of the hopper 101, while FIG. 5B illustrates the hopper/ram interface of this embodiment in FIG. 5A from an elevational view. Where the rear wall 501 meets the opening 103, a knife edge 503 is affixed. Knife edge 503 could be a straight blade (not shown) or comprise multiple serrations 507. The drawing further depicts ram 110 and upper shield 107 partially withdrawn from its fullest extension. The rear edge of the upper shield 107 includes a second blade 505, which, like the first blade attached to the rear hopper wall 501, may be serrated or straight. Blades are made from hard, durable substances, for example steel, or the like. Other materials, such as carbide, may be combined with the blade as well.

Figure 6C:
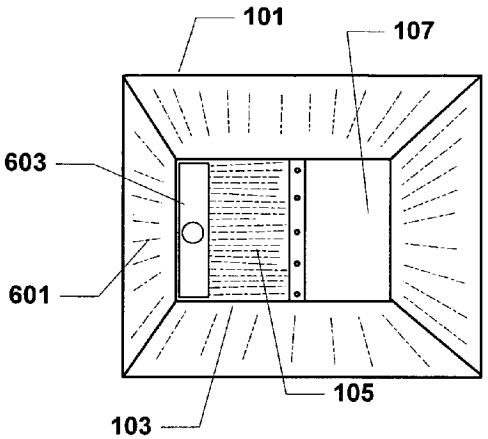
FIG. 6C is a top plan view of a further embodiment of the hopper of FIG. 6A.
Figure 6B:
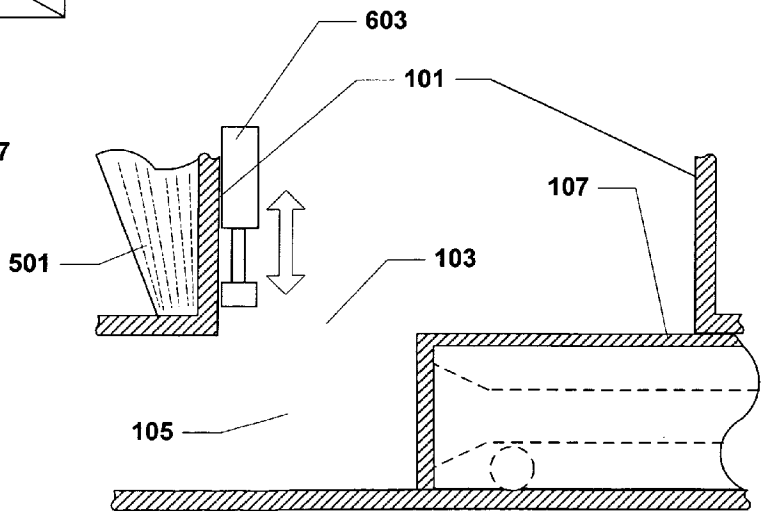
FIG. 6B is a side elevational view of the embodiment depicted in FIG. 6A.
Figure 6A:
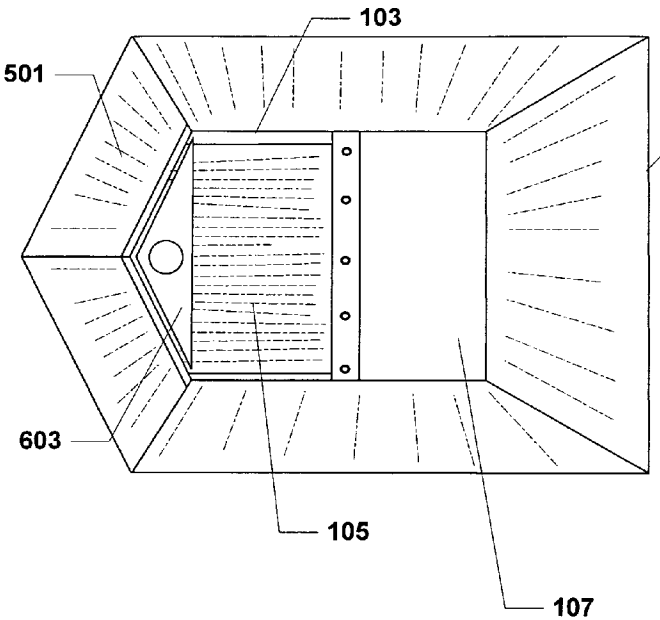
FIG. 6A is a top plan view of another embodiment of the hopper including a hydraulic ram for forcing waste material into the channel.

In a further embodiment, shown in FIGS. 6A-C, the hopper 101 includes a ram 603 that forces debris downward into the channel 105. In this embodiment the ram head may be shaped to conform to the shape of the rear wall 501, 601 of the hopper. For example, in FIGS. 6A and B, the rear wall 501 is the angled rear wall first discussed with respect to FIGS. 5A, B. In this instance, the ram head 603 conform on one side to the angle of the rear wall 501. On the other hand, FIG. 6C illustrates an example wherein the rear wall 601 is squared. The ram head 603 is, therefore, also squared to conform to the shape of the rear wall 601.

Figure 7:
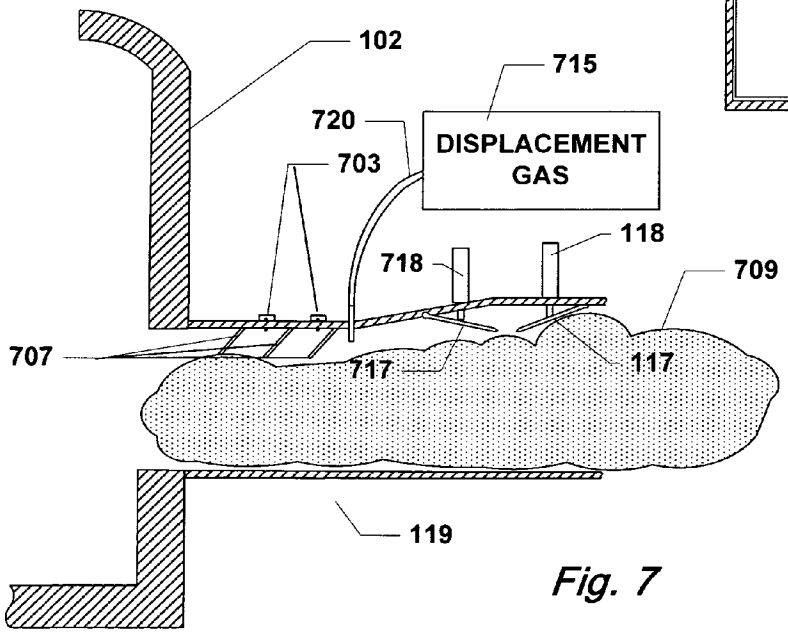
FIG. 7 is a side elevational view of the throat area of the apparatus.
Figure 20:
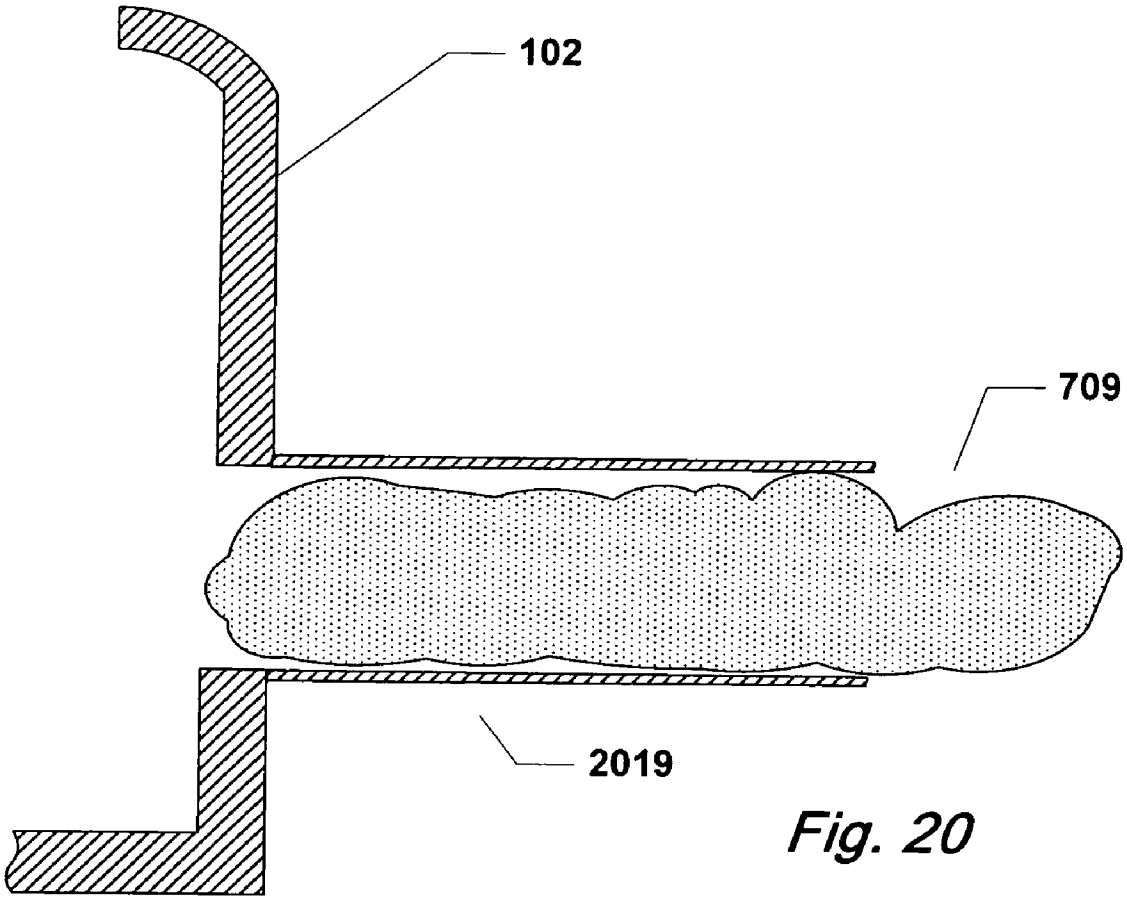
FIG. 20 is an elevational view of an alternative embodiment of the throat area.

Since the furnace 102, particularly when it is a plasma furnace, operates at such a high temperature, the throat area experiences such extreme temperatures. Furthermore, hot gas from the reaction chamber in the furnace may escape back into the throat area 119 which could ignite the unprocessed waste inside the throat area and channel 105. With reference to FIG. 7, throat area 119 comprises one or more temperature sensors 703 which sense temperature in that area and provide temperature data to a control system. The control system is configured with control logic to determine whether the temperature in the throat area exceeds a prescribed maximum, and if so, initiates a shut-down of the system, which could include the closing of the isolation door 121 (FIG. 1). Although sensors 703 are shown in the top of the throat area structure, it should be appreciated that sensors may be placed anywhere within the throat structure. And, with reference to FIG. 20, an alternative embodiment of the throat area 2019 is shown where the throat area does not narrow, but is configured to maintain a generally uniform cross-section until the entry to the reactor.

Another possible feature of the throat structure is a series of articulated baffles 707 that are pivotally attached to the top inside of the throat area 119 and extend across the top of the throat area. These baffles 707 prevent hot gas from flowing back through the throat area from the furnace, and are articulated such that a baffle is allowed to move along with the movement of waste material being processed 709. Baffles 707 may be formed from any suitable rigid, durable, heat-tolerant material, for example, steel, stainless steel, or fiber-reinforced ceramics.

A further safety feature that may be included is a system for infusing an inert, non-reactive, displacement gas into the throat. For example, a supply of nitrogen 715 may be coupled to the throat area through a supply line 720 that has an open end within the throat 119. If there is a back up of hot gas in the throat area as a result of, for example, an increase in system pressure, a signal from the sensors 703 provides data to the control system which is configured with control logic that subsequently issues a command to release nitrogen under pressure into the throat area to displace the hot gas and force it back into the reactor.

Optionally, the compaction box 115 could include a second actuator-impelled plate 717 mounted downstream from the restrictor plate 117. This plate 717 is also pivotally attached by one side, but by the downstream side. Actuation of the second plate 717 using an actuator 718 further compacts the material and helps to insure continued forward movement of the debris toward the reactor chamber.

Figure 19A:
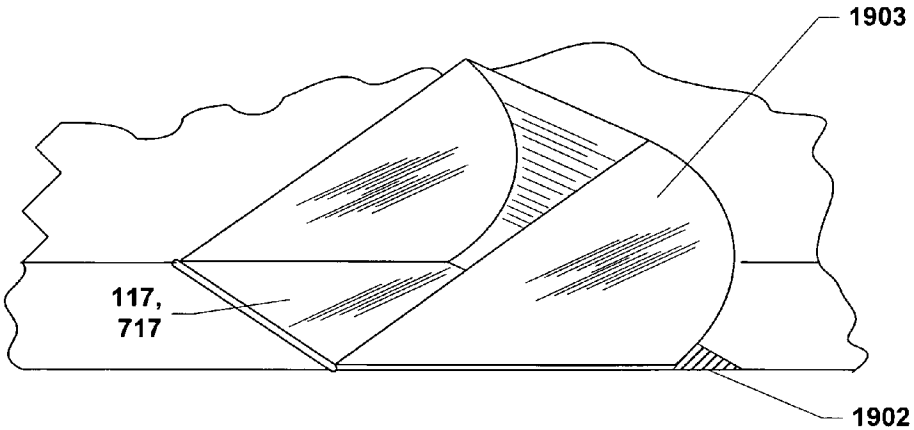
FIG. 19A is a perspective view isolating on a restrictor plate in the retracted or stowed position.
Figure 19B:
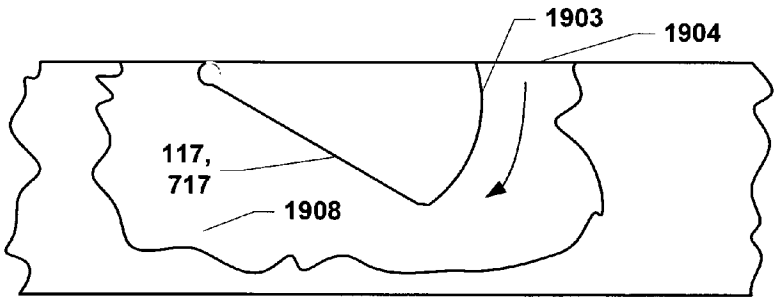
FIG. 19B is an elevational cut-away view of the plate extended into the compaction box.
Figure 19C:
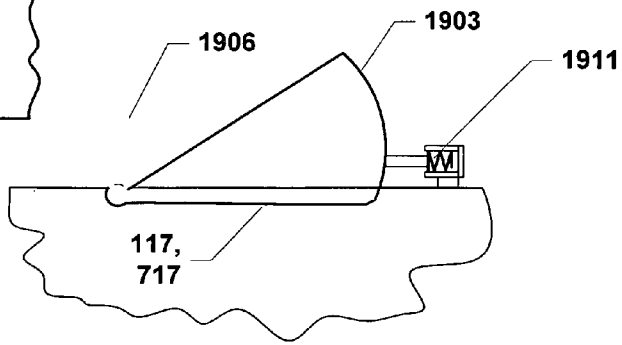
FIG. 19C is an elevational view of the plate retracted.

With reference to FIG. 19, each of the actuator-impelled plates 117, 717 could include an arcuate shroud 1903 extending from the plate's free end. In this embodiment, the plate 117, 717 is mounted within an aperture 1902 defined in the ceiling 1904 of the compaction box 115 such that the plate is either flush with the ceiling or parallel to the ceiling when the plate is retracted. The shroud 1903 extends upward to the top exterior 1906 of the compaction box 115. When the plate is commanded downward into the compaction box interior 1908, the shroud 1903 prevents debris from accumulating on top of the plate. When the plate 117, 717 is retracted the shroud 1903 recesses above the compaction box 115 again. To prevent debris from entering the area above the compaction box 1906 into which the shroud 1903 is recessed, a spring-loaded scrape bar 1911 may be mounted along the edge of the hole 1902 adjacent the shroud and in contact with the shroud surface.

Figure 12:
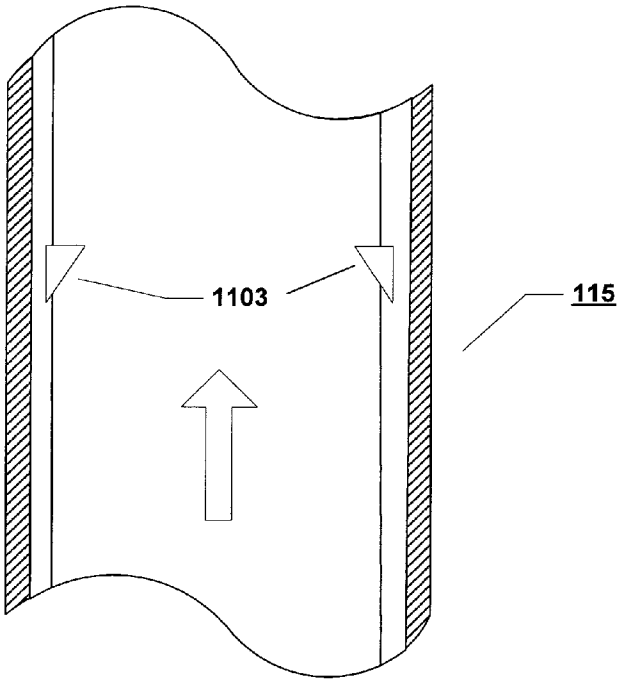
FIG. 12 is an overhead plan view of the exemplary compaction box of FIG. 11.
Figure 11:
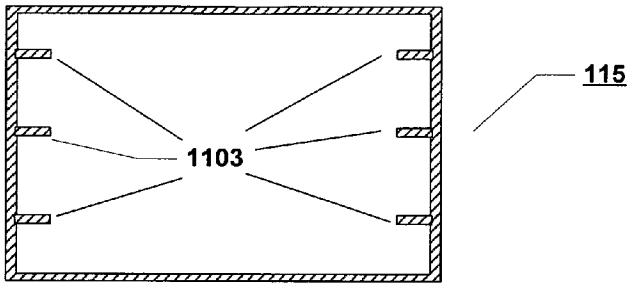
FIG. 11 is a head-on elevational view of an exemplary compaction box according to another embodiment.
Figure 13:
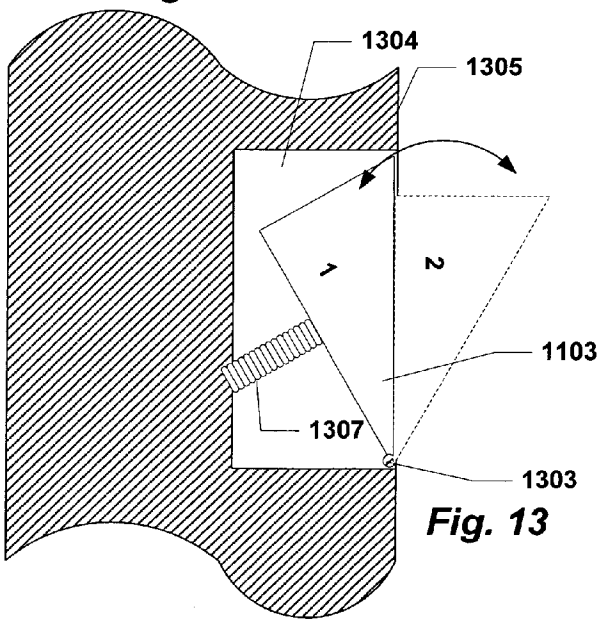
FIG. 13 is a detailed overhead view of a dog according to a further embodiment.

In yet another embodiment, and with reference to FIGS. 11-13, compaction box 115 may include "dogs" 1103 which protrude from the lateral walls of the compaction box area 115. Dogs 1103 have a protruding portion extending into the space of the channel and tapering down to a narrow portion. Dogs 1103 may approximate a right triangle with a long leg mounted to the wall and oriented on the walls such that the apex of the triangle is toward the direction of the oncoming material being pushed by the ram, the direction of material movement being indicated by the arrow in FIG. 12, and the wider portion is then oriented toward the downstream end. The purpose of the dogs is to prevent backward movement of the material after compaction in the compaction area.

The material is forced past the dogs 1103 and is allowed to move past the dogs 1103 by virtue of the tapering shape of the dogs 1103. Once the material is beyond the dogs 1103, depending upon what comprises the material, it may have tendency to be somewhat resilient and therefore, decompress and "spring" backwards. The wide portion of the dogs 1103 catches the material and prevents such backward movement.

Dogs 1103 may be triangular, as shown in the figures, or may include a hook shape at the wide portion. Further, dogs may be immovably affixed to the wall of the compaction area 115, or, as shown in FIG. 13, be configured to withdraw into the wall. In FIG. 13, dog 1103 is pivotally mounted within a recess 1304 in a wall 1305 of the compaction area. In this embodiment the apex of the triangle is secured with a pivoting fastener 1303. A load member 1307 is mounted within the recess 1304 with one end secured to the lateral outer wall of the recess and the other end to the long leg of the dog 1103. The load member 1307 is compressible to allow the dog 1103 to be pushed into the recess 1304 as material brushes against it, shown in the Figure as position 1. The load member 1307 forces the dog to its original protruding position (position 2) once the material has been pushed beyond the dog 1103. A final means of temperature control of the apparatus in the throat area could be providing water cooling the throat structure, or using a cooling jacket (not shown).

The apparatus may be run with one closed loop hydraulic system that powers the three separate hydraulic actuators described above. Alternatively, each actuator may be a self-contained hydraulic system. Hydraulic system may be charged to between about 1500 psi to about 5000 psi to deliver to the ram 110 about 50 psi to about 400 psi imparted on the waste material. This range is best when large or hard materials are expected to be processed, where breaking or chopping of the material is required. The ram 110 may be operated for municipal solid waste at a minimum of between about 140 to 145 psi, and preferably about 142 psi. Ideally, the ram is preferably configured to deliver up to about a 10-to-1 compression ratio on the waste material. Also, the ram 110 may be a regenerating hydraulic system as is known in the art.

The apparatus includes other sensors (not shown) that also provide data to control the process. For example, there may be a sensor to measure the speed of the waste material in the compaction box 115 or in the throat area 119. Data from this sensor, which could be an optical sensor, an IR sensor, an RF sensor, or any other sensor of suitable medium, is received by the control system which is configured with control logic to adjust the speed or number of strokes of the ram 110.

Another way to control the rate of waste feed to the furnace 102 is through analysis of the gases and materials and particulates exhausted from the process. Most gases exhausted from plasma furnace processes include carbon dioxide, nitrogen, carbon monoxide, hydrogen and water. There may also be some particulate matter exhausted with the gas. If there is too much particulate matter, e.g., between about 100 to about 300 ppm, it may be concluded that waste material is being fed too rapidly because not enough of it is reacting. A particulate matter sensor (not shown) may be installed in the exhaust of the furnace that detects the amount of particulates and provides this date to the control system, which is configured with control logic to adjust the speed (cycling of the ram 110) accordingly.

Figure 15B:
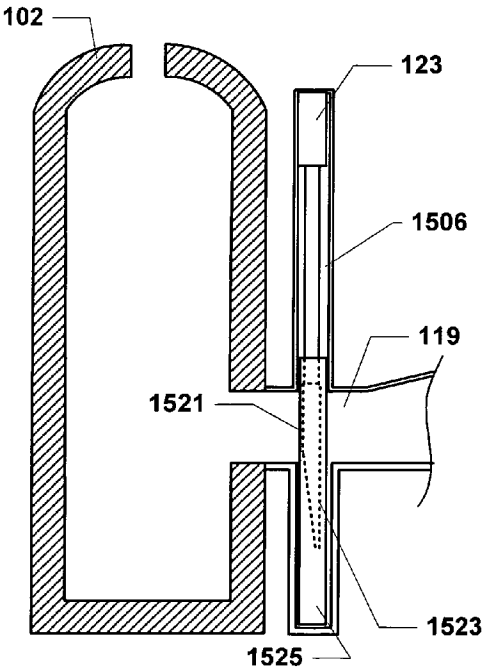
FIG. 15B illustrates the isolation door of FIG. 15A in the closed position.
Figure 15A:
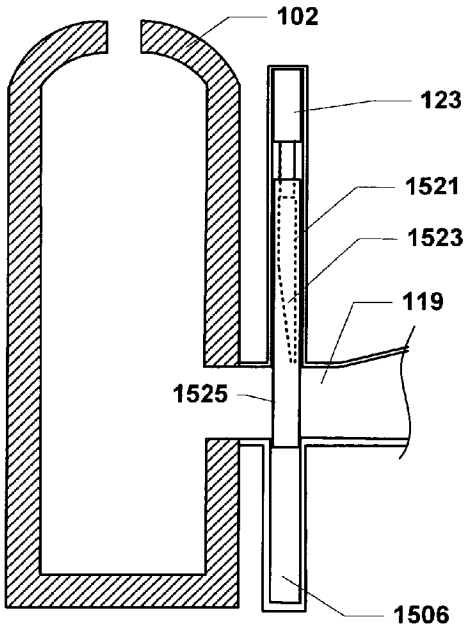
FIG. 15A illustrates an isolation door according to an embodiment of the present invention.
Figure 16B:
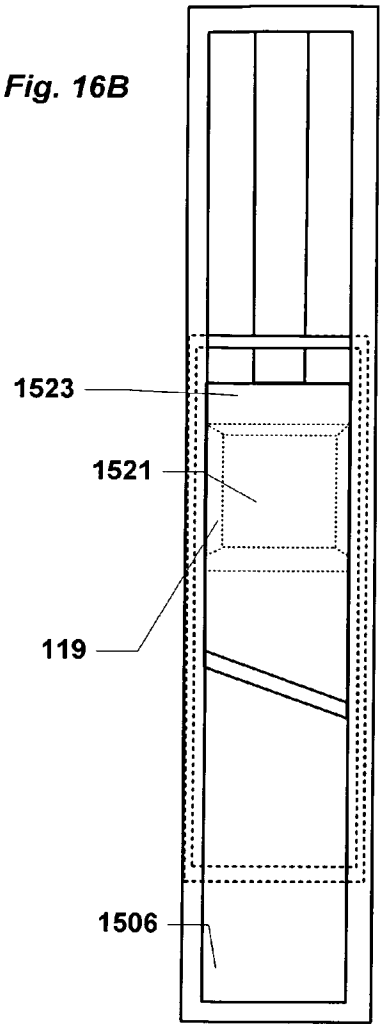
FIG. 16B is the isolation door of 16A from the reactor side and in the closed position.
Figure 16A:
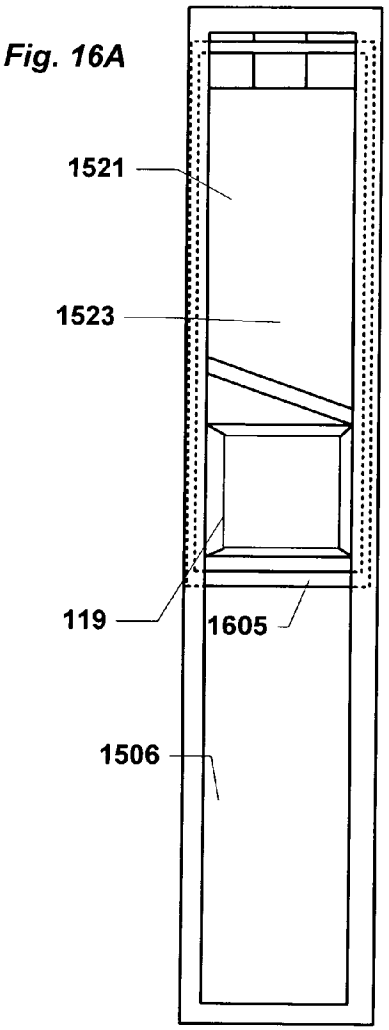
FIG. 16A is the isolation door of FIG. 15A viewed from the reactor side and in the open position.

With reference now to FIGS. 15A, B and 16A,B, a version of a isolation door 1521 for use with the conveying apparatus will be described. Isolation door 1521 is actuated from second actuator 123, but is retracted during normal operation of the reactor. Isolation door 1521 preferably includes a blade portion 1523 suitable for shearing the debris bolus when forced downward by actuator 123. Isolation door 1521 is either formed of, or includes a surface toward the reactor side coated with, a refractory material in order to allow isolation door to withstand the reactor environment when it is in the downward position (FIG. 15B). The throat area 119 is configured with a chamber 1506. Isolation door 1521 is mounted within a frame 1525 that is slidably engaged with the walls of the chamber 1506. During operation, when the isolation door 1521 is opened the bottom portion 1605 of the frame 1525 is at a height such that the top surface thereof is co-equal with the floor of the throat area 119. When the isolation door 1521 is commanded closed, the actuator moves the frame and the isolation door together downward (FIGS. 15B and 16B).

Figure 17:
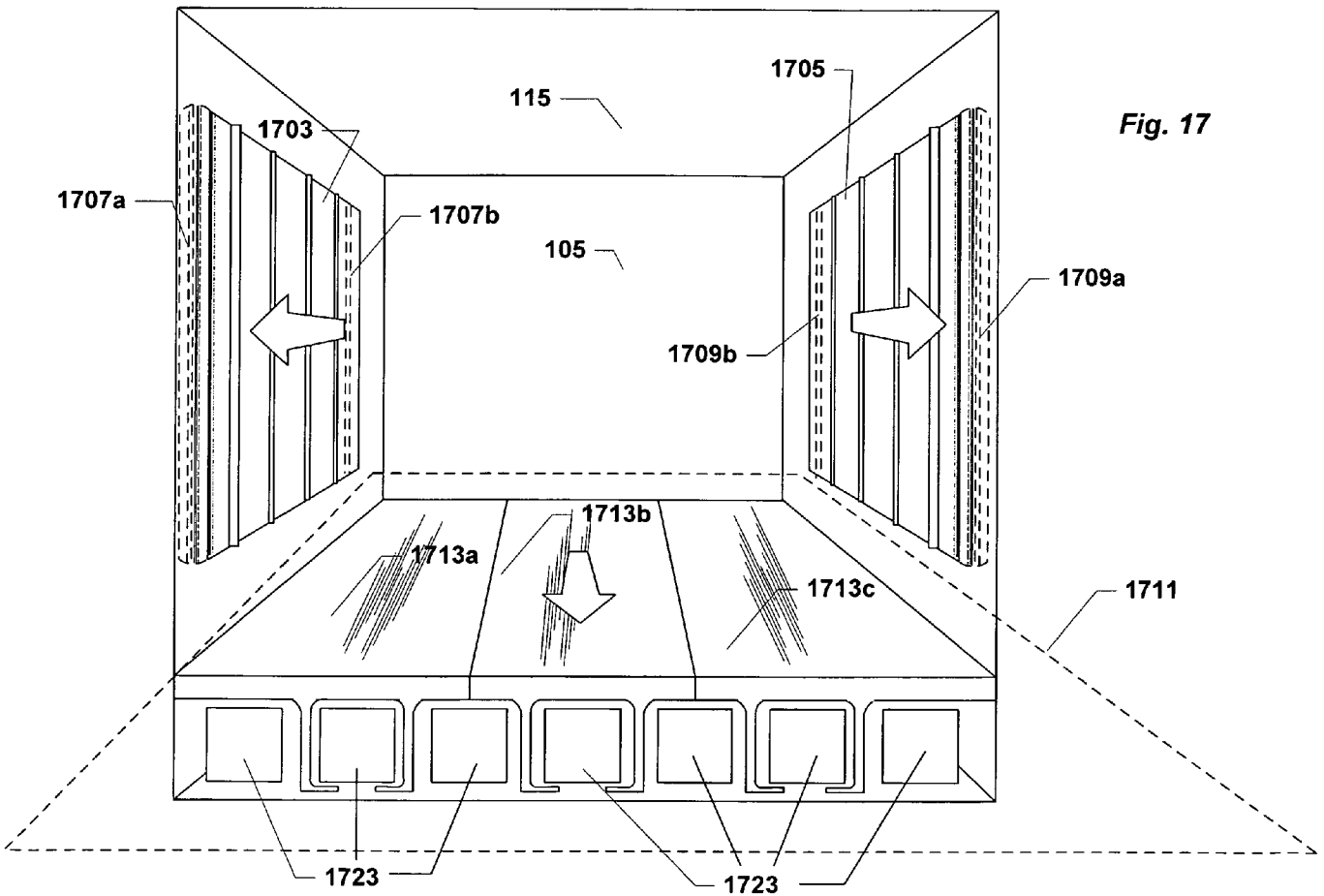
FIG. 17 is a view of the throat area from the perspective of the reactor chamber.

As taught above, it is desirable to maintain a constant feed of the reactor chamber to control the output of the syngas. To this end, other features may be incorporated into the compaction area and the throat area. FIG. 17 looks through the compaction box 115 toward the channel 105 from the perspective of the reactor. The walls of the compaction box 115 include motor-driven, vertically mounted conveyor belts 1703, 1705 that are operable to convey debris toward the reactor (direction indicated by arrows). The motor(s) for driving the conveyor belts 1703,5 (not shown) are mounted to the exterior of the compaction box 115 walls. Rollers 1707, 1709 around which the conveyor belt is disposed are vertically oriented, also outside the walls of the compaction box 115. Motor is coupled to at least one vertical roller 1707, 1709 on each side in order to rotate the roller in order to mover the conveyor belt. As those skilled in the art would appreciate, the conveyor belts 1703, 5 could also be implemented using motors driving a shaft upon which is mounted gear or cog which in turn is engaged with the conveyor belt.

Another optional feature is that of a "walking floor" 1711. Two or more floor slats 1713*a, b, c* are slidably engaged with one another and with rails 1723 mounted to a sub-floor of the compaction box 115. A motor is coupled to the slats and is configured to cause reciprocating movement thereof, in tandem. As one slat moves toward the reactor, the adjacent slat remains in its position until the moving slat stops. The adjacent slat then moves and the cycle is repeated. This alternating iterative movement of the slats serves to urge the contents of the compaction box toward the reactor. A version of the walking floor is described in U.S. Pat. No. 5,560,472 to Gist, issued Oct. 1, 1996, and which is incorporated by reference herein.

Figure 18:
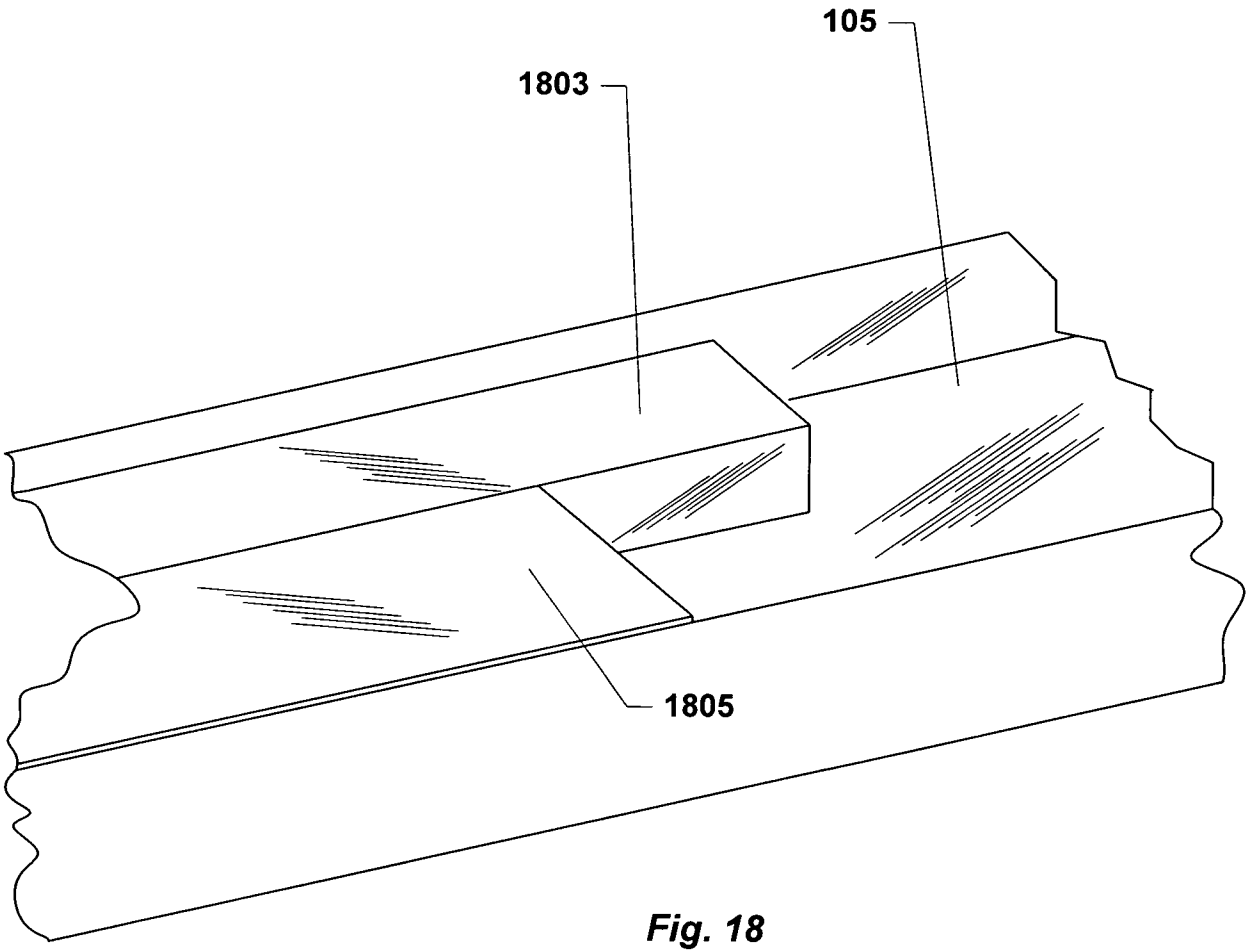
FIG. 18 is a perspective view of the channel area showing an embodiment with two rams.

Shown in FIG. 18, a further alternative feature is a double ram 1803, 1805. When employing a single ram, when the ram retracts, the elasticity of the debris may allow the debris cluster to expand backward until the ram extends again. The double ram operates in tandem, thus keeping substantially constant pressure on the debris as it moves through the channel 105.

As described above, control of the hydraulic mechanisms and other functions of the apparatus may be implemented with a computer system (not shown) configured with program logic to cause the computer system to execute the functions required.

The detailed description that follows is presented largely in terms of processes and symbolic representations of operations performed by conventional computers, including computer components. A computer may be any microprocessor or processor (hereinafter referred to as processor) controlled device, such as, by way of example, personal computers, workstations, servers, clients, mini-computers, main-frame computers, laptop computers, a network of one or more computers, mobile computers, portable computers, handheld computers, palm top computers, set top boxes for a TV, interactive televisions, interactive kiosks, personal digital assistants, interactive wireless devices, mobile browsers, or any combination thereof. The computer may possess input devices such as, by way of example, a keyboard, a keypad, a mouse, a microphone, or a touch screen, and output devices such as a computer screen, printer, or a speaker.

The computer may be a uniprocessor or multiprocessor machine. Additionally, the computer includes memory such as a memory storage device or an addressable storage medium. The memory storage device and addressable storage medium may be in forms such as, by way of example, a random access memory (RAM), a static random access memory (SRAM), a dynamic random access memory (DRAM), an electronically erasable programmable read-only memory (EEPROM), a programmable read-only memory (PROM), an erasable programmable read-only memory (EPROM), hard disks, floppy disks, laser disk players, digital video disks, compact disks, video tapes, audio tapes, magnetic recording tracks, electronic networks, and other devices or technologies to transmit or store electronic content such as programs and data.

The computer executes an appropriate operating system such as Linux, Unix, Microsoft® Windows® 95, Microsoft® Windows® 98, Microsoft® Windows® NT, VISTA® Apple® MacOS®, IBM® OS/2®, and later versions thereof. The computer may advantageously be equipped with a network communication device such as a network interface card, a modem, or other network connection device suitable for connecting to one or more networks.

The computer, and the computer memory, may advantageously contain program logic or other substrate configuration representing data and instructions, which cause the computer to operate in a specific and predefined manner as, described herein. The program logic may advantageously be implemented as one or more modules. The modules may advantageously be configured to reside on the computer memory and execute on the one or more processors. The modules include, but are not limited to, software or hardware components that perform certain tasks. Thus, a module may include, by way of example, components, such as, software components, processes, functions, subroutines, procedures, attributes, class components, task components, object-oriented software components, segments of program code, drivers, firmware, micro-code, circuitry, data, and the like.

The program logic conventionally includes the manipulation of data bits by the processor and the maintenance of these bits within data structures resident in one or more of the memory storage devices. Such data structures impose a physical organization upon the collection of data bits stored within computer memory and represent specific electrical or magnetic elements. These symbolic representations are the means used by those skilled in the art to effectively convey teachings and discoveries to others skilled in the art.

The program logic is generally considered to be a sequence of computer-executed steps. These steps generally require manipulations of physical quantities. Usually, although not necessarily, these quantities take the form of electrical, magnetic, or optical signals capable of being stored, transferred, combined, compared, or otherwise manipulated. It is conventional for those skilled in the art to refer to these signals as bits, values, elements, symbols, characters, text, terms, numbers, records, files, or the like. It should be kept in mind, however, that these and some other terms should be associated with appropriate physical quantities for computer operations and that these terms are merely conventional labels applied to physical quantities that exist within and during operation of the computer.

It should be understood that manipulations within the computer are often referred to in terms of adding, comparing, moving, searching, or the like, which are often associated with manual operations performed by a human operator. It is to be understood that no involvement of the human operator may be necessary, or even desirable. The operations described herein are machine operations performed in conjunction with the human operator or user that interacts with the computer or computers.

It should also be understood that the programs, modules, processes, methods, and the like, described herein are but an exemplary implementation and are not related, or limited, to any particular computer, apparatus, or computer language. Rather, various types of general purpose computing machines or devices may be used with programs constructed in accordance with the teachings described herein. Similarly, it may prove advantageous to construct a specialized apparatus to perform the method steps described herein by way of dedicated computer systems with hard-wired logic or programs stored in nonvolatile memory, such as, by way of example, read-only memory (ROM).

As described above and shown in the associated drawings, the present invention comprises an apparatus for conveying solid waste to a furnace. While particular embodiments of the invention have been described, it will be understood, however, that the invention is not limited thereto, since modifications may be made by those skilled in the art, particularly in light of the foregoing teachings. It is, therefore, contemplated that any claims issuing in an ensuing patent will cover any and all such modifications that incorporate those features or those improvements that embody the spirit and scope of the present invention.

I claim:

1. An apparatus for conveying solid waste to plasma furnace comprising:

a. an elongated channel comprising a first region having an opening through which waste material is received into said channel and a second region having an outlet open to a furnace through which waste exits said channel and enters the furnace and one or more baffles attached to the upper interior surface of said second region of said channel;

b. a reciprocating ram located within first region of said channel at an end of said channel opposite said outlet for forcing waste toward said outlet, said ram having a head plate of the same general shape as the channel and an upper shield dimensioned to be slightly greater in area than said opening such that when said ram is extended said opening is blocked;

c. an actuator-impelled restrictor plate for compressing waste that is forced through said channel, said restrictor plate pivotally mounted to the interior of said channel within said first region of said channel in an area through which the waste passes prior to entering said second region; and d. a door operable to close off said channel positioned within said second region of said channel.

2. The apparatus of claim 1, wherein said door further comprises a refractory surface oriented toward said furnace.

3. The apparatus of claim 2, wherein said second region is narrower than said first region.

4. The apparatus of claim 2, wherein said second region includes a ceiling that is lower than a ceiling of said first channel.

5. The apparatus of claim 1, further comprising a supply of inert gas coupled to a supply line configured to carry said inert gas into said second region of said channel for displacing gas back toward said furnace.

6. The apparatus of claim 1, wherein said ram further comprises a plurality of wheels mounted to a ram support structure.

7. The apparatus of claim 1, wherein said ram further comprises one or more skid plates for decreasing friction.

8. An apparatus for conveying solid waste to a furnace comprising:

a. an elongated channel comprising a first region having an opening through which waste material is received into said channel and a second region having an outlet open to a furnace though which waste exits said channel and enters the furnace, and wherein said second region is narrower than said first region and wherein said channel further comprises one or more baffles attached to the upper interior surface of said second region of said channel;

b. a reciprocating ram located within first region of said channel at an end of said channel opposite said outlet for forcing waste toward said outlet, said ram having a head plate of the same general shape as the channel and an upper shield dimensioned to be slightly greater in area than said opening such that when said ram is extended said opening is blocked;

c. an actuator-impelled restrictor plate for compressing waste that is forced through said channel, said restrictor plate pivotally mounted to the interior of said channel within said first region of said channel in an area through which the waste passes prior to entering said second region; and d. an isolation door operable to close off said channel positioned within said second region of said channel.

9. The apparatus of claim 8, further comprising a scrape plate mounted to said opening along the interior wall thereof near the position of furthest retraction of said ram, such that a free edge of said plate extends toward said upper shield at an angle.

10. The apparatus of claim 8, further comprising guide blocks attached to the upper interior walls of said channel for preventing upward movement of said ram during extension.

11. An apparatus for conveying solid waste to a furnace comprising:

a. an elongated channel comprising a first region having an opening through which waste material is received into said channel and a second region having an outlet open to a furnace through which waste exits said channel and enters the furnace, said channel including longitudinally disposed guide bars mounted to the lateral interior walls of said channel and wherein said second region is narrower than said first region;

b. a reciprocating ram located within first region of said channel at an end of said channel opposite said outlet for forcing waste toward said outlet, said ram having a head plate of the same general shape as the channel and an upper shield dimensioned to be slightly greater in area than said opening such that when said ram is extended said opening is blocked and having lateral recesses for accommodating said guide bars;

c. an actuator-impelled restrictor plate for compressing waste that is forced through said channel, said restrictor plate pivotally mounted to the interior of said channel within said first region of said channel in an area through which the waste passes prior to entering said second region; and d. an isolation door operable to close off said channel positioned within said second region of said channel.

12. The apparatus of claim 8, wherein said channel further comprises chamfered corners.

13. The apparatus of claim 8, further comprising a first knife edge mounted to said opening along an interior wall opposing said ram head.

14. The apparatus of claim 13, further comprising a knife edge mounted to the top portion of the ram head plate.

15. The apparatus of claim 14, wherein first knife edge comprises serrations.

16. The apparatus of claim 8, further comprising a second ram for forcing waste through said opening and into said channel.

17. The apparatus of claim 8, further comprising a plurality of protrusions extending from the interior lateral walls of said channel, each of said protrusions having a narrow end and a wide end, wherein said protrusions are oriented such that said narrow end is toward the on-coming waste.

18. The apparatus of claim 17, wherein at least one of said protrusions are pivotally mounted within a cavity recessing into an interior lateral wall of said channel, wherein said at least one protrusion is biased to extend into said channel.

19. The apparatus of claim 8, wherein said second region of said channel further includes one or more thermal sensors.

20. The apparatus of claim 8, further comprising one or more pressure sensors for measuring the pressure experienced by said ram, said pressure sensors configured to couple a signal to a control system, said control system further configured to vary pressure experienced by an actuator impelling said restrictor plate, wherein said pressure of said actuator is varied inversely to said pressure of said ram.

* * * * *